227-120 SP
8/7/84 XR 4,463,890

United States Patent [19]

Ruskin

[11] Patent Number: 4,463,890

[45] Date of Patent: Aug. 7, 1984

[54] STAPLERS

[76] Inventor: Henry Ruskin, 21 Nomahegan Ct., Cranford, N.J. 07016

[21] Appl. No.: 333,372

[22] Filed: Dec. 22, 1981

[51] Int. Cl.[3] ..... B25C 5/06

[52] U.S. Cl. ..... 227/132; 227/8; 227/120; 227/146

[58] Field of Search ..... 227/120, 129, 132, 134, 227/145, 146, 8

[56] References Cited

U.S. PATENT DOCUMENTS

| | | | |
|---|---|---|---|
| 1,927,274 | 9/1933 | Baur | 227/146 |
| 2,137,642 | 11/1938 | Cavanagh | 227/132 |
| 2,154,755 | 4/1939 | Virantz | 227/129 X |
| 2,940,079 | 6/1960 | Langford | 227/120 |
| 4,126,260 | 11/1978 | Mickelsson | 227/132 |

*Primary Examiner*—E. R. Kazenske
*Assistant Examiner*—Douglas D. Watts

[57] ABSTRACT

The disclosed stapler has a manual actuator that is depressed to force a staple magazine against papers on an anvil, charging a leaf spring that carries a staple driver. A stop arrests the staple driver during this operation of the actuator. The staple driver is released by the actuator near the end of the actuator's stroke, to drive a staple through the paper and to cause the anvil to set the staple's legs. The manual actuator releases the staple driver for spring-impelled operation by deflecting the staple driver off the stop.

11 Claims, 5 Drawing Figures

STAPLERS

The present invention relates to manually operated staplers.

BACKGROUND

In staplers, a staple driver forces a staple to penetrate a group of papers supported on an anvil, the legs of the staple finally being set by the anvil against the back of the papers. This operation is performed almost universally in staplers currently available by a staple driver that is itself driven by force transmitted from the user's hand. These may be called "manual-drive" staplers.

Hesitation and relaxation of effort by the user of a manual-drive stapler results in retraction of the staple driver. Similar effects occur when a stapler is just "slapped" without enough effort to advance and curl the legs of the staple against the anvil. Under such conditions, another staple tends to be advanced partially into driving position, and when the stapler is operated again, it tends to become jammed.

Some manual staplers have been equipped with stroke-completion mechanisms. Those mechanisms are intended to block return motion of the staple driver even if the user's effort is relaxed before the staple-driving stroke is completed. Such mechanisms increase the cost of the staplers, and the stroke-completion mechanism is itself an occasional cause of jamming. Consequently, most staplers on the market are not equipped with stroke-completion mechanisms.

Electrically operated staplers avoid the problems related to hesitation by the user for, once the operating switch is closed, the stapler ordinarily operates in its prescribed stroke. The electric stapler is designed to provide ample effort to complete its stroke under all normal circumstances, taking into account the sharpness of standardized staples and the toughness and maximum number of sheets to be stapled together. However, electric staplers are costly and massive so that manual staplers are vastly more common.

Staples are also used in tackers, where the staple is driven into a thick object, as in tacking a poster to a wooden post. Manually-operated tackers commonly use a staple driver that is powered by a spring. During most of the stroke a manual operating lever compresses the spring, and the staple driver is released over the end of the operating stroke to drive the staple into the work. There is no anvil nor any need for an anvil.

SUMMARY OF THE INVENTION

An object of the present invention resides in providing novel manual staplers in which hesitation or slap-operation by the user cannot cause a partial staple-driving stroke, without resort to st In achieving this object, the novel stapler described in detail below utilizes a charged spring for impelling the staple-driver. Stored energy develops in the spring during most of the downward or operating stroke of the manual actuator. The staple-driver is only released near the end of the actuator's downward stroke. Thereafter, advance of the staple driver is not determined by the manual actuator but is independently determined by the spring alone. It is not rendered uncertain in any way by hesitation or casual effort of the user.

A further object of the invention resides in provision of a novel spring-impelled staple driving mechanism, more particularly such a mechanism that is amenable to low-cost, compact incorporation in staplers.

The exemplary stapler detailed below achieves the foregoing objects and includes other novel features and has advantages noted below. That stapler comprises a base that carries a movable "head" having two main parts. One main part of the head is a staple-supporting arm (ordinarily a staple magazine) that is pivoted to the base. The other main part of the head is a manual actuator. The staple-supporting arm is elongated, and the manual actuator is also elongated and overlies the staple-supporting arm. A leaf spring is disposed between the actuator and the arm, resulting in a compact and economical construction. One end of the leaf spring is fastened to the actuator, and the staple driver is fastened to the opposite or operating end of the leaf spring. To special advantage, the actuator has a restrainer to prebias the spring. The term "leaf spring" is used here to refer to a wide and elongated element of spring stock, but also refers to plural stacked elements of that kind acting together and simulating a single leaf-spring element.

Pressure of the manual actuator toward the anvil initially moves the staple driver against a stop carried by the staple-carrying arm, and moves the staple-carrying arm against the material on the anvil. Near the end of its downward, operating stroke the actuator releases the staple driver from its stop. In the illustrated stapler this is done by deflecting the staple driver off the stop and into line with the staple that is supported in guided driving position. Upon release of the staple driver, the stored energy in the spring is effective to operate the staple driver with ample force to penetrate a sheaf of paper and to drive the legs of the staple against the anvil so that they bend back against the back of the sheaf of paper.

Hesitant or "slapping" effort applied to the manual actuator may result in an incomplete operating stroke of the actuator. However, return motion of the actuator would then be of no consequence. The staple driver cannot be operated partially due to improper effort by the user. Just as in the case of an electric stapler, there is no need for a stroke-completion mechanism.

After a staple has been driven and as the operating manual pressure is relaxed, the manual actuator is raised by the leaf spring until the staple driver is freed for return to its position opposite its stop, and until the spring retainer arrests the leaf spring in its prebiased condition. Another spring then lifts the head of the stapler away from the base and in condition for use again.

The nature of the invention and the foregoing and other novel features and advantages will be better appreciated from the following detailed description of the exemplary yet illustrative embodiment of the invention shown in the accompanying drawings.

In the drawings:

FIG. 5 represents the parts just before a staple is driven.

Figure 3:
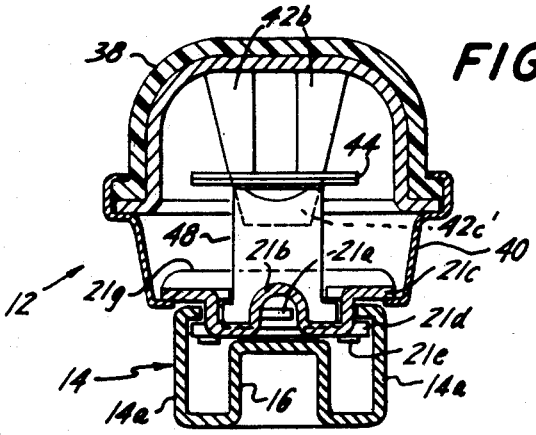
FIG. 3 is aportion of the novel stapler at the plane 3—3 of FIG. 2.
Figure 4:
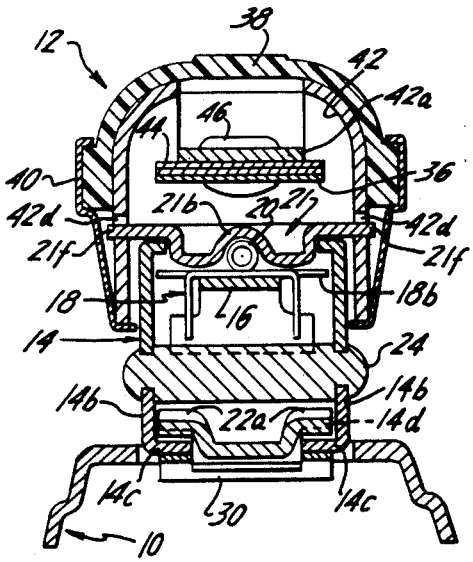
FIG. 4 is an enlarged cross-section of the novel stapler along the broken line 4—4 of FIG. 2.

In the drawings, the illustrated stapler includes three main units, the base 10, the cover or manual actuator 12 and the staple-supporting arm 14, here being a staple magazine. Arm 14 here is in the form of a one-piece stamping, prominently including rail 16 of inverted-U cross-section (FIG. 3). A stick of staples is biased along rail 16, to the left in FIG. 4, by a spring 20 and a staple follower 18 that is complementary to and slidable on the rail. The follower has a hook portion 18*a* joined to the tensioned coil spring 20. The left-hand end of spring 20 (FIG. 2) engages a fixed hook 21*a*, being part of staple cover plate 21 that receives spring 20. Cover plate 21 (FIG. 3) also has flanges 21*c* and 21*d* above and below in-turned margins of side-walls 14*a* of magazine 14. Cover plate 21 is spaced from rail 16 sufficiently for free (but guided) movement of the staples and the staple follower 18. Stops 21*e* on flanges 21*d* (FIG. 3) are close to the left-hand end (FIG. 2) of rail 16 in the paths of wings 18*b* to prevent the follower from moving into the path of staple-driver 48 (described below).

Figure 2:
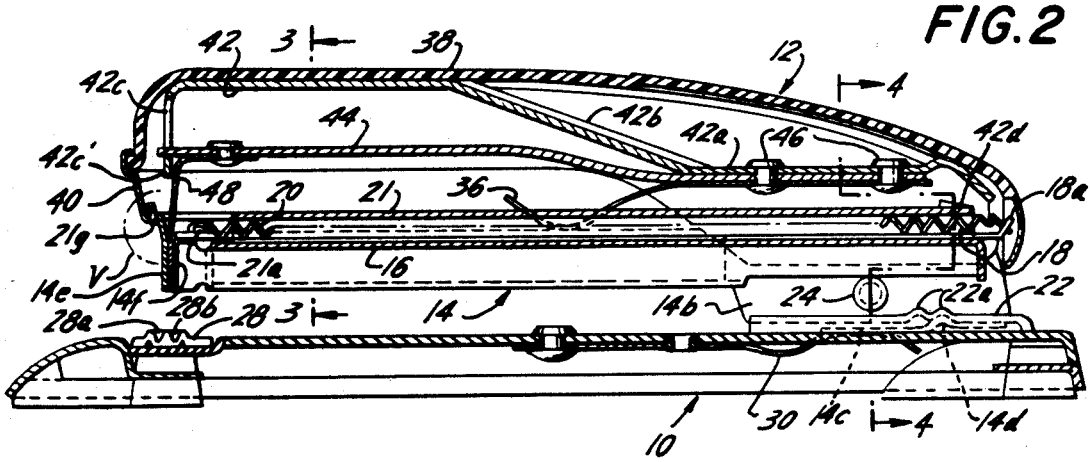
FIG. 2 is a vertical cross-section of the novel stapler along its length.

At the right-hand end of the stapler in FIG. 2 (see also FIG. 4), there are two elongated metal flanges 22, which are raised integral portions of base 10. The openings under flanges 22 are free at the left extreme (FIG. 2) and closed at the right extreme. Two bosses 22*a* are formed in each flange 22, providing two pairs of recesses in the lower faces of the flanges.

At their right-hand ends in FIG. 2, side walls 14*a* or arm 14 are enlarged to constitute a pair of depending panels 14*b* (see also FIG. 4) which are firmly spaced apart by a two-headed shouldered rivet 24. (The metal for these side extensions 14*b* is taken largely by discontinuing the side walls of channel 16, leaving only a top surface at the right-hand extremity of the rail for guiding staple follower 18.) In-turned flanges 14*c* of panels 14*b* are received in the spaces under raised flanges 22 of base 10. Flanges 14*c* are received in slots in base 10. (Those slots were formed as a result of raising flanges 22 from base 10.)

Figure 1:
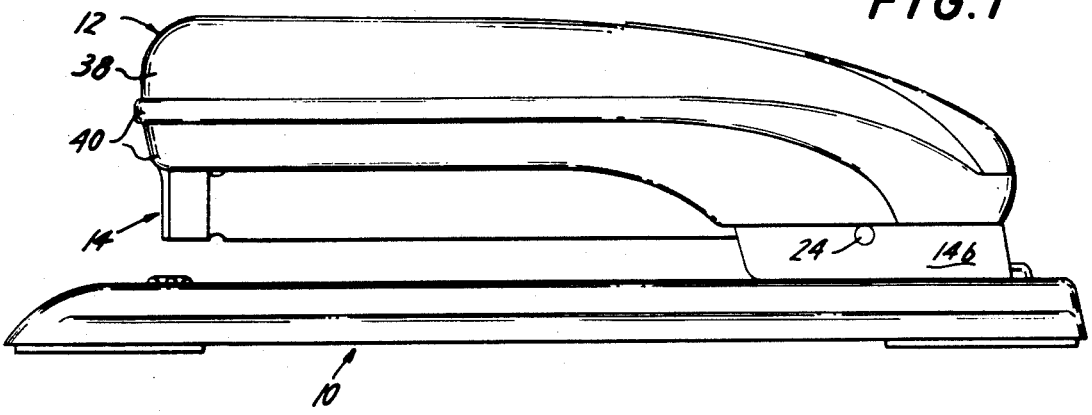
FIG. 1 is a side elevation of a novel stapler, being an illustrative embodiment of the features of the invention.

Bosses 14*d* bulge upward from flanges 14*c* and are received in a selected pair of recesses formed by bosses 22*a*. Depending on which of the recesses 22*a* are selected, a driven staple will engage a corresponding recess 28*a* or 28*b* in anvil 28. These recesses in the anvil are of well-known design to curl the legs of the staple either inward or outward against the back of the sheets on the anvil. Selection of one of these recesses is performed in a convenient manner, by grasping head 12–14 in one hand and shifting it bodily along base 10, to the left or right in FIG. 1.

The construction described also enables the user to remove head 12–14 from base 10, for use as a tacker. This is done by shifting flanges 14*c* to the left and out of the open left hand ends of flanges 22.

Leaf spring 30 has two strips that act on flanges 14*c* to the left of bosses 14*d*. In this way, leaf spring 30 acts to hold head 12–14 in its raised at-rest position shown, and spring 30 also biases bosses 14*d* into the selected recesses formed by bosses 22*a*. Spring 30 yields readily when actuator 12 is pressed down, and when the actuator is released thereafter, spring 30 restores head 12–14 to the elevated position shown.

Cover unit or manual actuator 12 includes three main parts that are united. Cover part 38 of unit 12 is advantageously a molded plastic part. Lower part or skirt 40 is ordinarily of sheet-metal having unifying margins formed about a peripheral rib extending along the sides and across the ends of part 38. Inner shell or frame 42 as of sheet-metal is generally complementary to cover part 38 and is suitably fixed therein.

A horizontal panel 42*a* is struck from inner shell 42. Panel 42*a* remains rigidly fixed to shell 42 by virtue of a strut 42*b* at the left-hand end of panel 42*a* and because panel 42*a* extends integrally from the rest of shell 42*a* at the right, as seen in FIG. 2.

A leaf-spring 44 (here actually two identical laminae that are face-to-face throughout their lengths) is fixed to panel 42*a* as by rivets 46 which also secure leaf spring 36 to panel 42*a*. The left-hand end of leaf spring 44 is narrowed to extend through a slot in depending restrainer 42*c* of shell 42. Leaf-spring 44 is pre-biased downward against end portion 42*c*′ of depending restrainer 42*c*.

Figure 5:
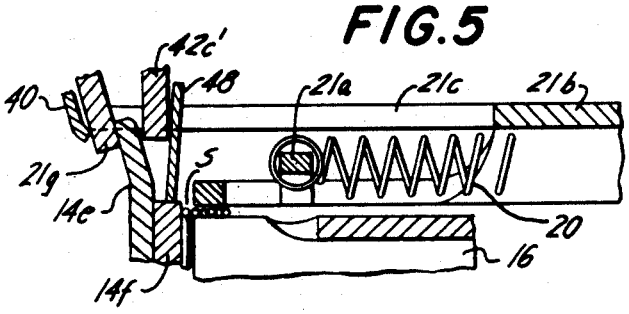
FIG. 5 is a greatly enlarged detail of the portion of the stapler designated by the broken line V in FIG. 4, but unlike FIG. 2.

As seen in FIGS. 2 and 5, vertical walls 14*a* of the staple magazine have portions 14*e*, 14*f* at their left-hand extremity that overlap one another opposite the left-hand end of staple-guiding rail 16. Portion 14*e* extends upward well above the level of rail 16 and slopes slightly to the left in FIG. 5, whereas the upper edge of portion 14*f* constitutes a horizontal shoulder slightly above the staples on rail 16. The left-hand end of rail 16 is spaced slightly more than one staple-thickness away from the opposite face of shouldered portion 14*f*.

A staple driver 48 as of spring steel is secured by one or more rivets to leaf spring 44. When the stapler is at rest, cover unit 12 is raised by spring 36 so that the lower edge of driver 48 is somewhat above shouldered portion 14*f*. Depending portion 42*c* of the shell is positioned so that, in its downward movement, it is almost in line with the shoulder of portion 14*f* of the staple magazine. Portion 42*c* is somewhat resilient. In its downward movement, portion 42*c* engages the sloping surface of magazine part 14*e* and is thereby cammed to the right in FIG. 5 and into alignment with the shoulder or rail portion 14*f*. Portion 42*c* is as thick as, or preferably slightly thicker than, rail portion 14*f*. Consequently portion 14*e* pushes staple driver 48 off the stop 14*f*, being a shouldered portion of arm 14 which includes rail 16 as an integral part. A staple S is located in the staple-guiding passage between rail 16 and the shouldered portion 14*f* of the magazine. At the instant that staple driver 48 is freed of restraint by shouldered portion 14*f*, it is formed by spring 44 to drive staple S into work on anvil 28. The leaf-spring member 48 that forms the staple driver is self-biased to dispose its staple-engaging end to overlie the shouldered stop 14*f* in the at-rest condition of the apparatus. After the staple driver is deflected free of the stop surface, that same self-bias presses staple-driver 48 against the lateral face of part 14*f* which adjoins the stop surface. The staple-guiding surface opposite the end of rail 16 becomes the guide surface of staple driver 48. Upon its release, staple driver 48 is necessarily aligned with the lead staple of the stick of staples on rail 16 that is biased against the guide surface by staple follower 18.

The driving force that impels staple driver 48, by design, is ample to penetrate a sheaf of paper and to clinch the legs of the staple against the back of the sheaf. The spring force results from its pre-bias against portion 42*c*′ and the added stored energy that builds up when cover portion 12 is pivoted toward the staple magazine until driver 48 is released. This force can, by design, be ample to cause a staple to pierce a specified number of sheets of paper of specified thickness and toughness.

Specifications for the stiffness of staples are based on such values. Part 42c is proportioned so that, at the completion of a staple-driving stroke, spring 44 does not strike spring restrainer 42c'. For this result, actuator 12 is to be designed for movement downward relative to magazine 14 a distance of at least the length of the staple legs before staple driver 48 is pushed off stop 14f by part 42c.

It has been indicated that cover or manual actuator 12 is pivoted, in order to operate as above. Cover part 42 has openings 42d that receive arms 21f of staple cover plate 21. Therefore actuator 12 can tilt relative to plate 21 which is maintained in assembly with staple arm 14 by flanges 21c and 21d disposed above and below the in-turned flanges of side walls 14a (FIG. 3) as described above.

As seen in FIGS. 2, 3 and 5, plate 21 has a transverse part 21g that latches with the tip of part 14e. Actuator 12 can be lifted forcibly, due in part to looseness of the in-turned flanges of walls 14a between flanges 21c and 21d, to raise part 21g above part 14e. Thereafter actuator 12 and plate 21 can be shifted to the right a considerable distance. In this way, rail 16 can be exposed for loading. Additionally, the staple guide between part 14f and rail 16 can be cleared in case a deformed or mis-fed staple should become jammed. After staples have been loaded on rail 16, actuator 12 can be shifted to the left, and parts 21g and 14e can be latched again.

The downward operation of actuator 12 in the operating stroke of the stapler has been described above. After a staple has been driven, relaxation of manual pressure allows the stapler to be restored to readiness for another operation. Springs 36 and 44 first raise arm 12 upward relative to the magazine. After restrainer portion 42c' rises enough to engage spring 44, spring 36 continues to lift actuator 12 until staple driver 48 clears stop 14f and springs into position above the stop. At this time, skirt 40 rises so as to engage part 21g (FIG. 5) of the staple cover plate. Thereafter cover 12 and magazine 14 are moved upward as a unit to open the space above anvil 28.

The stapler described in detail and shown in the accompanying drawing represents the presently preferred embodiment of the various features of the invention. However, it is apparent that those skilled in the art can readily modify this embodiment so that the invention should be construed broadly in accordance with its true spirit and scope.

What is claimed is:

1. A stapler including an elongated base having an anvil near one end thereof, an elongated arm overlying said elongated base, said arm having a portion remote from the anvil pivoted to said base and having a rail for supporting a stick of staples with its lead staple free of an end of the rail opposite the anvil, and staple-driving means overlying the arm, said staple-driving means including a staple driver retracted from the staples in the at-rest condition of the apparatus, spring means for operating the staple driver, a stop carried by said arm and cooperable with a latch portion of the staple driver for arresting the staple driver against operation by the spring means, and manual actuating means for developing progressively increased energy stored in said spring means, said apparatus having means for biasing a portion of the staple driver for cooperation with the stop, and said manual operating means having a releasing portion acting on said staple driver for disengaging the latched portion thereof from said stop, thereby releasing the staple driver to staple work on said anvil.

2. A stapler as in claim 1 wherein said stop forms a fixed portion of said elongated arm, and wherein said manual actuating means comprises a common activating member acting in its operating stroke to increase the energy stored in said spring means as aforesaid and acting to displace said staple driver including the latch portion thereof out of cooperation with said stop.

3. A stapler as in claim 1 wherein said manual actuating means comprises an elongated member overlying the elongated arm and pivoted adjacent to the pivot of the elongated arm and said elongated member having a driver-release formation cooperable with said staple driver for displacing the latter out of cooperation with said stop during the operation of said elongated member.

4. A stapler as in 3 wherein said spring means for operating said stapler driver comprises at least one elongated leaf spring disposed between said elongated arm and said elongated member, said leaf spring having an end portion remote from said anvil fixed to said elongated member for adapting the elongated member to increase the stored energy in the leaf spring progressively so long as the staple driver remains latched.

5. A stapler as in claim 1 wherein said manual actuating means comprises an elongated member overlying said elongated arm, said elongated member bearing said releasing portion and having a pivot at the end thereof remote from said anvil, said elongated arm having a camming formation adjacent said stop, the portion of said staple driver that engages and drives the staples being the latch portion engageable with said stop, said staple driver incorporating said means biasing it for cooperation of its latch portion with said stop, and said releasing portion of said elongated member being cooperable with both said camming formation and said staple driver for displacing the latch portion of the staple driver out of cooperation with said stop and thereby releasing said staple driver.

6. A stapler as in claim 5 wherein said spring means for operating said staple driver comprises at least one elongated leaf spring disposed between said elongated arm and said elongated member, said leaf spring having an end portion remote from said anvil fixed to said elongated member for enabling the elongated member to increase the stored energy in the leaf spring progressively so long as the staple driver remains latched, said staple driver being a leaf-spring member secured at one end thereof to an end portion of said leaf spring generally opposite said anvil, said leaf-spring member incorporating the means which biases the latch portion thereof for cooperation with said stop.

7. A stapler as in claim 1 wherein said manual actuating means comprises an elongated member overlying said elongated arm and having a pivot at the end thereof remote from the anvil, and wherein said spring means for operating said staple driver comprises at least one elongated leaf spring disposed between said elongated arm and said elongated member, said leaf spring having an end portion remote from said anvil fixed to said elongated member for adapting the elongated member to increase the stored energy in the leaf spring during the operation thereof so long as the staple driver remains latched.

8. A stapler as in claim 7 wherein restraining means portion of the staple driver that is biased for cooperation with the stop prior to its release from the stop is also the portion of the staple driver that engages and drives the successive staples, and wherein the means which biases the staple driver for cooperation with the stop before release of the staple driver is also effective for biasing the staple driver against said staple guide surface after release from the stop.

9. A stapler as in claim 1 wherein said stop adjoins a guide surface opposite to the end of the rail, wherein the portion of the staple driver that engages and drives the successive staples, and wherein the means which biases the staple driver for cooperation with the stop before release of the staple driver is also effective for biasing the staple driver against said staple guide surface after release from the stop.

10. Staple driving apparatus having staple driving mechanism and means including a rail for supporting a stick of staples with its lead staple clear of the end of the rail and in driving position, said staple driving mechanism including a staple driver operable in staple-driving and return strokes, a spring for operating said staple driver, a manual actuating device for charging said spring, and latching means for arresting said staple driver while the spring is being charged by said manual actuating device, said latching means comprising a stop fixed in cting said staple driver out of cooperation with said stop for thereby releasing said latching means after charging said spring, said spring including first and second portions having respective drive connections to said manual actuating device and to said staple driver that are sustained both during charging of the spring by said manual actuating device and during the staple-driving stroke of the staple driver, said manual actuating device having a manually operable portion at least approximately aligned with said staple driver at the side thereof opposite to its direction of travel in driving a staple.

11. Staple driving apparatus as in claim 10 wherein said means for deflecting said staple driver out of cooperation with said stop comprises a manually operable member bearing a latch-releasing element for deflecting said staple driver, and said apparatus including a reaction element disposed adjacent to but spaced from said staple driver in position for forcible entry of said latch releasing element between the staple driver and the reaction element.

* * * * *